United States Patent [19]

Beckwith

[11] 4,368,823

[45] Jan. 18, 1983

[54] HANGING NECKTIE HOLDER

[76] Inventor: Irwin W. Beckwith, Box 45, 1617 Columbia Tpke., Castleton, N.Y. 12033

[21] Appl. No.: 239,178

[22] Filed: Mar. 2, 1981

[51] Int. Cl.[3] ..... A47F 5/08

[52] U.S. Cl. ..... 211/113; 211/89; 223/91

[58] Field of Search ..... 211/89, 113, 124, 45, 211/7, 8; 223/90, 91, 93, 96

[56] References Cited

U.S. PATENT DOCUMENTS

| | | | |
|---|---|---|---|
| 2,440,024 | 4/1948 | Schwiering | 211/89 |
| 2,459,006 | 1/1949 | Sova | 211/89 |
| 2,793,763 | 5/1957 | Hessel | 211/89 |
| 3,000,513 | 9/1961 | Horton | 211/124 X |

FOREIGN PATENT DOCUMENTS

| | | | |
|---|---|---|---|
| 631312 | 6/1936 | Fed. Rep. of Germany | 211/89 |

*Primary Examiner*—William H. Schultz
*Assistant Examiner*—Ramon O. Ramirez
*Attorney, Agent, or Firm*—Heslin & Watts

[57] ABSTRACT

A hanger type device that holds ties through the use of clamps which press the ties against the crossarm over which they are draped. The clamps can all be released simultaneously by raising a ring located within a recess at the center of the hanger, and a lock, also centrally located, can be engaged to maintain all the clamps in an open position.

7 Claims, 4 Drawing Figures

HANGING NECKTIE HOLDER

BACKGROUND OF THE INVENTION

This invention pertains to necktie holders which use clamps to hold the ties in position. This is usually accomplished by pressing the tie between a clamp and another part of the holder, thus creating a sufficient amount of friction to secure the tie in place. Generally, each clamp is operable between an open and a closed position.

In the prior art, there are two common types of necktie holders. The first type is adapted to be permanently attached to a wall and utilizes various types of clamps to secure the ties. Examples of these wall-mounted necktie holders can be found in the patents of Schwiering—U.S. Pat. No. 2,440,024; Edelheit—U.S. Pat. No. 2,633,995; and Sova—U.S. Pat. No. 2,469,006. The second type of necktie holder is similar in its general configuration to a clothes hanger of the standard kind and has a hook for engaging a clothes rod and a crossarm to which the ties may be attached. For examples of this type of tie holder, see the patents of Cappuzzello—U.S. Pat. No. 3,310,179; Keeler—U.S. Pat. No. 2,248,358; and Behlefeldt—U.S. Pat. No. 2,748,953. The hanging necktie holders are often preferred over their wall-mounted counterparts since they require less space than the wall units and are also more convenient to transport. This invention concerns tie holders of the hanger type.

With presently available hanging necktie holders, removing a tie normally entails either holding the release with one hand and selecting the tie with the other, or steadying the hanger with one hand and using the other to both release and hold the tie. In either case, one hand is usually required to securely maintain the clamp in an opened position. When operating the necktie holder in a crowded closet, it is often found that the clamp releases are either inaccessible or, at best, inconvenient to operate. Moving the clamp to its opened position is often difficult. This is primarily due to the fact that the clamp releases are located in an unprotected manner along either the sides or top of the hanger. Furthermore, should one wish to remove the hanger from the closet in order to choose his tie, he must use one hand to hold the hanger and the other to both release the clamp and choose the tie. The present invention eliminates the foregoing problems and is more convenient to operate than the tie holders of the prior art.

The desirability of any one tie holder over another depends primarily on convenience. There has long been a need for a more convenient tie holder where the ties can be easily attached and detached in what is usually a relatively limited amount of room in a closet. The present invention is a tie holder of the hanger type, having a plurality of individual tie clamps disposed along a crossarm. It incorporates a system whereby clamps can all be opened simultaneously by raising a single ring which lies within a recess beneath the hook at the center of the tie holder. This arrangement enables the user to simply grasp the tie holder with one hand and engage the ring with a finger of that same hand and release all of the ties. Thus, one hand is sufficient to both release the ties and steady the hanger, either while it is on the clothes rod or being held in the hand, so that a selection can be made with the other hand. Also, this invention incorporates a central lock which can be used to maintain all the clamps in their opened position. This lock is activated by simply turning the same ring which is used to release the ties, thereby allowing the user to open and lock the clamps in the opened position in one motion. In order to prevent any ties from slipping off the tie holder while the clamps are open, felt strips are affixed to those portions of the crossarm over which the ties are draped. Furthermore, the clamps are so structured as to define separate sections for individual ties extending in a series along the crossarm. The use of separate sections permits the removal of individual ties without disturbing the adjoining ties.

SUMMARY OF THE INVENTION

Accordingly, it is an object of this invention to provide a necktie holder of the hanger type wherein all the clamps are operable from a central location under its hook, thus enabling one to use the necktie holder with a single hand.

It is another object of the invention to provide a tie holder of the hanger type having a release means which is accessible and operable when the tie holder is in a crowded closet.

It is a still further object of the invention to provide a tie holder of the type indicated having means for releasing all the ties simultaneously.

It is a still further object of the invention to provide a necktie holder which is compact and easy to transport.

It is another object of the invention to provide a necktie holder having means for preventing the ties from bunching together.

It is another object of the invention to provide an improved tie holder which facilitates the removal of individual ties without disturbing the adjoining ties.

Further objects and advantages of the invention may be brought out in the following part of the specifications wherein certain small details have been described for completeness of the disclosure of the preferred embodiment without intending to limit the scope of the invention which is set forth in the appended claims.

Briefly described, the present invention is a simply constructed hanging necktie holder which has a crossarm over which the ties are draped. A plurality of "L" shaped tie clamps are positioned in an inverted manner such that the vertical legs extend downwardly through apertures in the crossarm and the horizontal legs extend along the top of the crossarm. The vertical legs are rigidly attached to an operating bar which lies below the crossarm. A clamp release, located beneath the hanging means, extends through the crossarm and engages the operating bar such that raising the release means also raises the operating bar and the associated clamps.

BRIEF DESCRIPTION OF THE DRAWINGS

Referring to the accompanying drawings which are for illustrative purposes:

FIG. 3 is an end elevation taken along line 3—3 of FIG. 2.

DESCRIPTION OF THE PREFERRED EMBODIMENT

Referring again to the drawings, the tie holder, generally designated as 10, is shown. The overall shape of the tie holder 10 is similar to a standard clothes hanger with a hook 12 attached to the middle portion of a crossarm 14.

Figure 1:
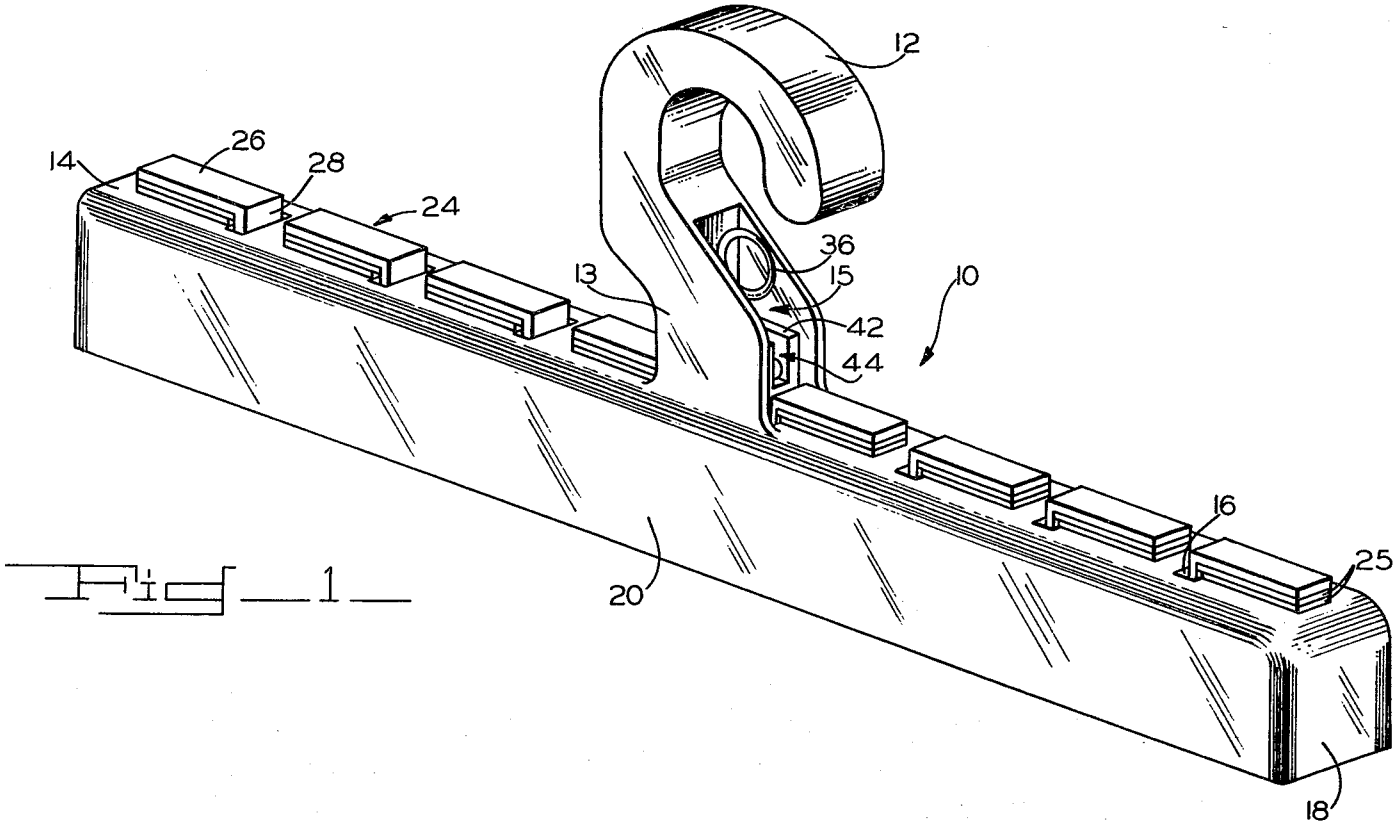
FIG. 1 is a perspective view of the invention.

The lower portion of hook 12 thickens to form base 13 which is equal in width to the crossarm 14. Within base 13, is a recess 15 which faces the same direction as hook 12. (See FIG. 1). Recess 15 lies beneath hook 12 and is formed by the side and rear walls of base 13.

Along the top of crossarm 14 at equally spaced intervals are apertures 16. Extending downwardly from crossarm 14 are end panels 18 and side panels 20, all of which are joined to form a hollow trough beneath the crossarm, said trough housing operating bar 22.

Clamps 24 are "L" shaped such that their horizontal legs 26 lie above and are parallel to the crossarm 14, and their vertical legs 28 extend downwardly through apertures 16 and are fastened to operating bar 22. (See FIG. 2). Thus, it will be appreciated that as operating bar 22 is raised, horizontal legs 26 are lifted off crossarm 14 to their open position and when the operating bar is lowered, the legs close upon the top of crossarm 14. The portion of the horizontal legs 26 and the crossarm 14 which are pressed together are both covered with felt 25.

At either end of operating bar 22 is a spring socket 30. A spring 32 is set in each socket 30 so as to expand between crossarm 14 and operating bar 22, thereby biasing the operating bar to its lowered position.

Release pin 34 is fashioned so as to have a ring portion 36 which lies in recess 15 and a rod portion 38. Rod portion 38 extends downwardly through crossarm 14 and through operating bar 22 where it is rotatably secured to operating bar 22 by means of a washer 40 and nut 41.

Figures 2, 5:
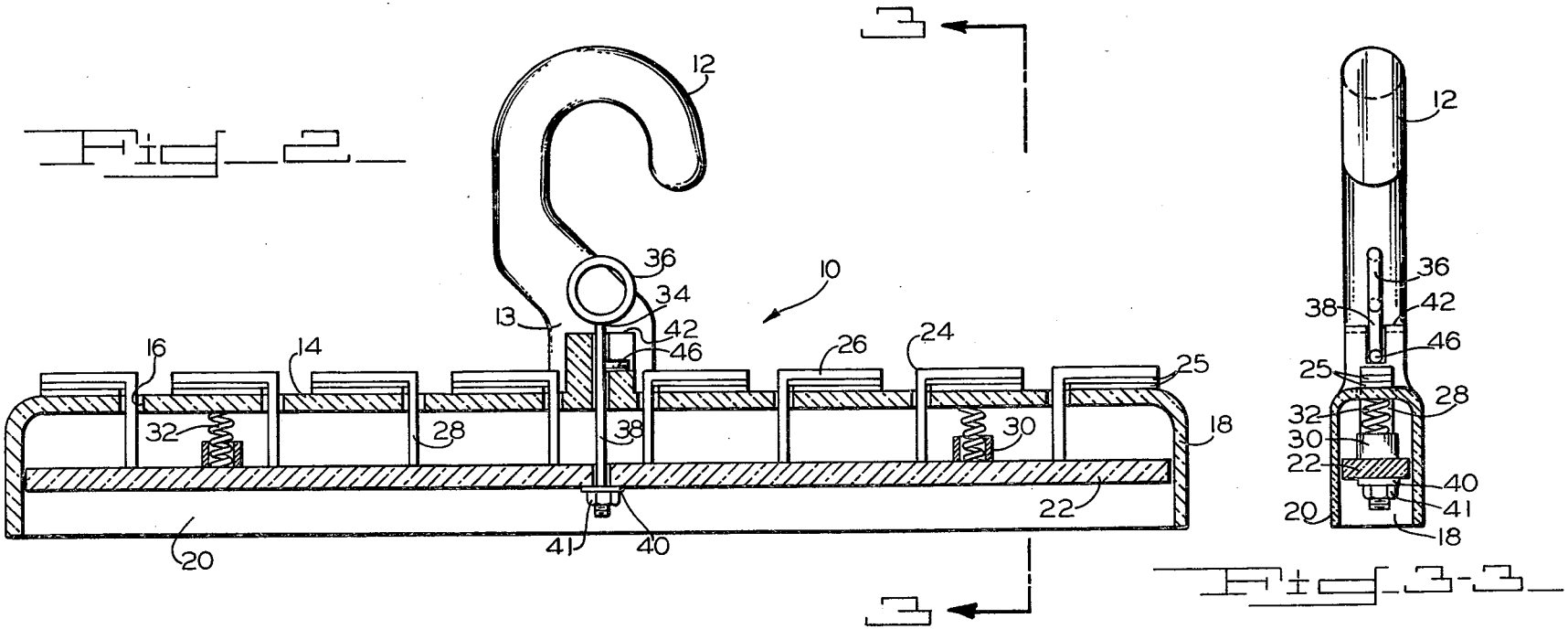
FIG. 2 is a side elevation with a side panel removed, disclosing the inner mechanisms of the preferred embodiment of this invention.

Within recess 15, ledges 42 extend horizontally along the inner sides of the base 13, defining a slot 44. (See FIG. 3). A locking stud 46 is attached perpendicularly to rod 38. Locking stud 46 is normally seated within slot 44, as shown in FIGS. 2 and 3. However, when ring 36 is raised and rotated 90° in either direction and released, stud 46 will rest on a ledge 42 thereby detaining operating bar 22 in its raised position. In this position, all clamps 24 are likewise raised, thus releasing all ties.

Figure 4:
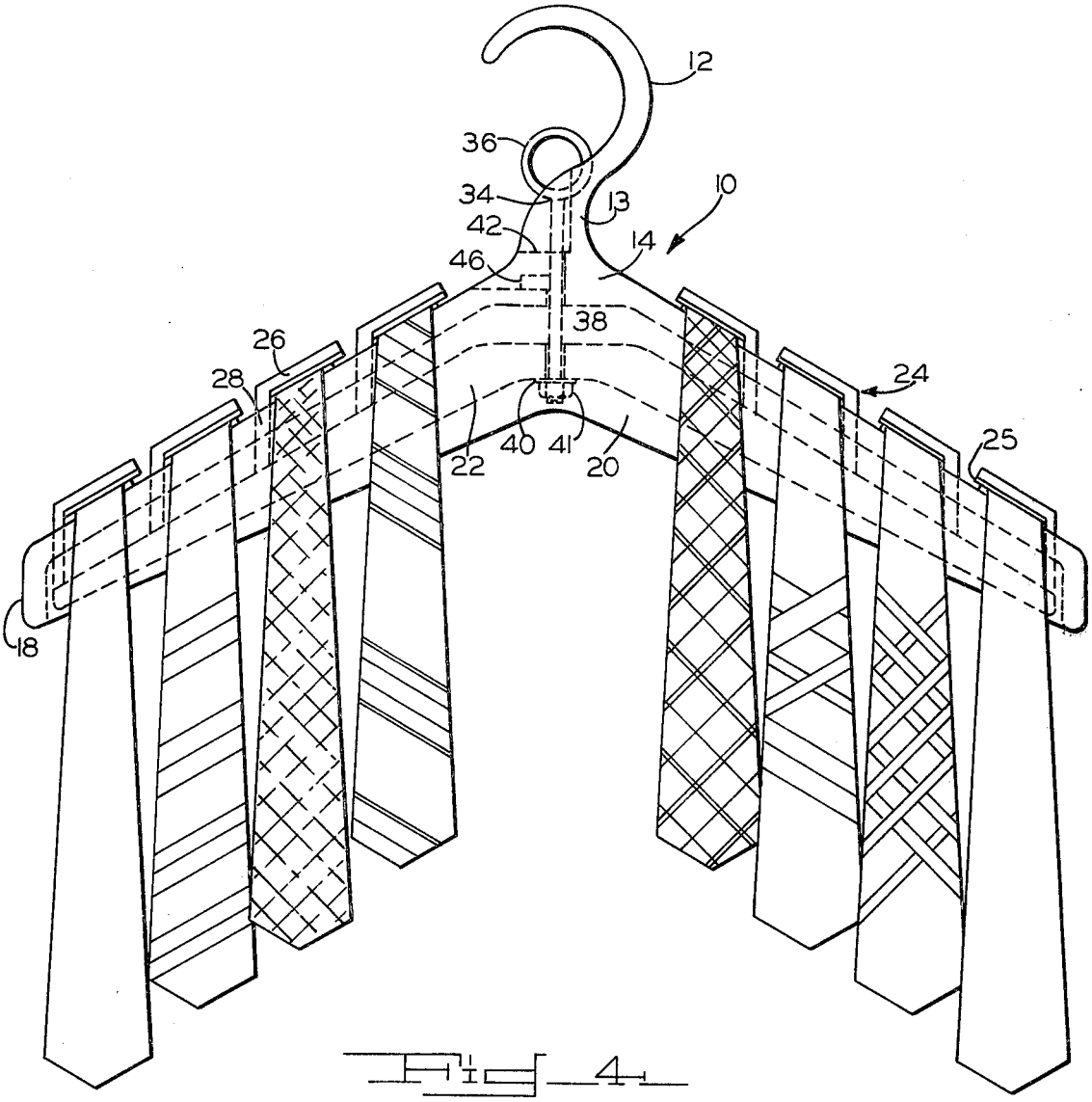
FIG. 4 is a side view of an alternate embodiment of the invention.

FIG. 4 shows an alternate embodiment of the invention wherein the primary modification is the downward angling of the crossarm. This modification necessitates a change in the clamps 24 such that the angle between the legs is changed from a right angle to an obtuse angle. Furthermore, the horizontal legs 26 of each clamp 24 must point in the direction of the hook 12 so as to prevent the slipping of ties off the now sloping crossarm.

In operation, the user will generally grasp hook 12 and either remove the tie holder from the closet or else simply steady it while it remains on the clothes rod. In either event, ring 36, which lies in protective recess 15, is engaged with a finger of that same hand and raised toward hook 12. The raising of ring 36 also raises associated operating bar 22 which compresses springs 32. The raising of operating bar 22 is guided by the end panels 18 and side panels 20 so as to assure a straight course to its raised position. This also assures that clamps 24, being rigidly attached to operating bar 22, are properly directed to their open position, releasing the ties. The raising of ring 36 also serves to raise locking stud 46 along slot 44 and above ledge 42. Thus, should it be desirable to maintain the clamps in their opened position without holding ring 36, the user can simply turn ring 36, thus moving locking stud 46 to a position over the ledge 42. The ring can then be disengaged lowering locking stud 46 until it comes to rest on ledge 42. Since this prevents operating bar 22 from returning to its original position, clamps 24 are locked in their open position. Once the tie has been chosen, ring 36 is turned, moving locking stud 46 back in line with slot 44, thereby allowing the return of clamps 24 to their closed position.

The operation of the alternate embodiment is similar to that above. One advantage of this alternate embodiment is that the configuration closely matches the hangers which one normally uses, thus making it more convenient to include the necktie holder with other clothing, especially when traveling.

Changes and modifications in this specifically described embodiment can be carried out without departing from the scope of the invention which is intended to be limited only by the scope of the appended claims.

What is claimed:

1. A hanging necktie holder comprised of:

a crossarm having a top surface upon which a plurality of ties may be draped, said crossarm having a plurality of apertures therein;

a plurality of tie clamps slideably mounted through the apertures of the crossarm at preselected intervals along said top surface, each clamp being operable between a closed position for securing a tie between itself and said top surface and an open position for permitting ties to be inserted between itself and said top surface or removed therefrom;

means attached to the crossarm for hanging the necktie holder from a suspension bar; and means for simultaneously moving the tie clamps between their opened and closed positions, said means being mounted on the holder sufficiently close to the hanging means to be operable by a single human hand while it is grasping the hanging means.

2. The invention of claim 1 wherein each tie clamp is "L" shaped, one of its legs overlying the top surface of the crossarm, the other extending downwardly through a crossarm aperture and wherein the operating means includes an operating bar to which each downwardly extending tie clamp is rigidly connected and wherein said operating means further includes means for raising or lowering said bar with respect to and in parallel relationship with the crossarm so as to operate each tie clamp between its opened and closed positions.

3. The invention of claim 1 or 2 wherein the means for moving the tie clamps includes means adapted to be engaged by a human hand and wherein said hand-engageable means is located within a recess under the hanging means, so that it is protected from interference by adjoining hangers.

4. The invention of claim 3 further comprising a means for simultaneously locking all of the clamps in their opened position.

5. The invention of claim 4 further comprising a means for biasing the clamps in their closed position.

6. The invention of claim 5 wherein the biasing means comprises at least one spring.

7. The invention of claim 1 wherein the crossarm slopes downwardly from the hanging means at a preselected angle with the vertical and wherein each clamp is shaped in the form of a modified "L" in that the legs thereof form an obtuse angle with one another, said obtuse angle being substantially the same as said preselected angle.

* * * * *